US006538596B1

(12) United States Patent
Gilbert

(10) Patent No.: US 6,538,596 B1
(45) Date of Patent: Mar. 25, 2003

(54) THIN, BROADBAND SALISBURY SCREEN ABSORBER

(75) Inventor: Roland A. Gilbert, Milford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 13 days.

(21) Appl. No.: 09/847,552

(22) Filed: May 2, 2001

Related U.S. Application Data

(60) Provisional application No. 60/201,158, filed on May 2, 2000.

(51) Int. Cl.[7] ..... H01Q 17/00
(52) U.S. Cl. ..... 342/1; 342/4
(58) Field of Search ..... 342/1, 2, 3, 4, 342/13; 343/841, 872

(56) References Cited

U.S. PATENT DOCUMENTS 2,599,944 A 6/1952 Salisbury
3,309,704 A * 3/1967 Klingler ..... 343/18
3,349,397 A * 10/1967 Rosenthal ..... 343/18
3,680,107 A * 7/1972 Meinke et al. ..... 343/18
3,733,606 A * 5/1973 Johansson ..... 343/18
4,038,660 A * 7/1977 Connolly et al. ..... 343/18
5,627,541 A 5/1997 Haley et al.

OTHER PUBLICATIONS

Skolnik, M. "Radar Handbook, 2nd ed.," McGraw Hill, Boston, 1990. pp. 11.46–11.48.*

* cited by examiner

*Primary Examiner*—Thomas H. Tarcza
*Assistant Examiner*—Brian Andrea
(74) *Attorney, Agent, or Firm*—Salzman & Levy

(57) ABSTRACT

The present invention provides a broadband RF absorptive structure based on a classic Salisbury screen. Closely-spaced frequency selective surface reflective layers interact with a ground plane to reflect coherent signals at 377Ω into a spacecloth front layer. The frequency response of the absorptive structure is relatively flat across an octave (i.e. a 2:1 frequency ratio) bandwidth. The overall thickness of the inventive structure is less than λ/4 thickness of the interactions of the FSS layers and the ground plane.

9 Claims, 3 Drawing Sheets

THIN, BROADBAND SALISBURY SCREEN ABSORBER

RELATED APPLICATIONS

This application claims priority from U.S. Provisional Patent Application Serial No. 60/201,158, filed May 2, 2000.

Field of the Invention

The present invention relates to attenuators for radio frequency (RF) energy and, more particularly, to a thin Salisbury screen using closely spaced frequency selective surfaces.

BACKGROUND OF THE INVENTION

Modern communications technology often requires radio frequency absorbing surfaces to achieve isolation between antennas and sometimes adjoining structures on host platforms. Applications such as providing isolation fences around antennas are typical for these absorbing structures. Traditional absorptive structures such as carbon-based surfaces generally need to be on the order of one wavelength thick to provide the required absorptive performance. Magnetic-based absorbers may be thinner but are generally much heavier, because of their dependence upon iron loading. This makes magnetic absorbers unsuitable for use in weight-conscious applications, in applications where the absorptive structures must withstand either atmospheric exposure or exposure to other corrosive materials. There has been a need to develop thin, lightweight, RF-absorptive structures which are capable of broadband absorptive performance.

The Salisbury screen is one well-known approach to achieving high degrees of RF-absorption over a narrow frequency band. U.S. Pat. No. 2,599,944 for ABSORBENT BODY FOR ELECTROMAGNETIC WAVES, issued to Winfield W. Salisbury, describes such a structure. SALISBURY teaches a composite structure which may be placed over essentially any surface to render that surface electromagnetically non-reflective. SALISBURY uses a graphite-coated canvas, spaced apart from a metal back surface (i.e., a ground plane) by wood blocks. The spacing is dependent U on the frequency to be absorbed, generally approximately $\lambda/4$. Circuit and transmission line theories may be used to show that the ground plane, which is a short circuit ($\approx 0\Omega$ impedance), is transformed to an open circuit ($\approx\infty\Omega$ impedance) at $\lambda/4$ distance from the ground plane. By placing the resistive sheet at $\lambda/4$ location, a $377\Omega$ impedance is placed in parallel with the reflected open circuit. This results in a structure in which an incident plane RF wave, which has a $377\Omega$ impedance in free space, is matched to the $377\Omega$ load sheet which then totally absorbs the incident wave's energy.

This effect occurs only at a single frequency. For this reason, Salisbury screens in their pure form have found little usage in practical, broadband RF-absorptive structures. In a typical application, an RF-absorptive structure might be required to absorb an incident, radar signal. While the Salisbury screen can be highly effective at a single frequency, the ease with which the radar system may be tuned to a different operating frequency renders the Salisbury screen essentially useless.

A broadband structure of a similar construction, however, could be quite useful. U.S. Pat. No. 5,1627,541 for INTERFERENCE TYPE: RADIATION ATTENUATOR, issued to Donald D. Haley, et al. teaches on such structure. HALEY, et. al. expands the concept of the Salisbury screen by placing a "spacecloth" in front of a plurality of reflective layers, each of the reflective layers being tuned to reflect a narrow range of frequencies. By properly placing the layers, the overall absorption of the structure may be increased. Each of the reflective layers still must be spaced $\lambda/4$ from the spacecloth. Each reflective layer must also be essentially transparent to other frequencies. Frequency selective surfaces (FSS), well known to those skilled in the RF arts, may be used to construct the HALEY, et al. structure. Still, a structure built in accordance with the teachings of HALEY, et al., capable of true wideband absorption, is unwieldy (i.e., thick) and expensive and, therefore, impractical for most modern applications.

The inventive wideband absorptive structure, however, overcomes many of the problems of the HALEY, et al. structure. The structure of the instant invention utilizes a spacecloth with a 377 ohm bulk impedance placed in front of a plurality of frequency selective surfaces. The spacings between the spacecloth and the individual reflective layers are not the traditional $\lambda/4$, but rather much closer spacings are utilized. The inventive structure, unlike that of HALEY, et al, utilizes the mutual coupling between the closely spaced FSS layers.

In a traditional Salisbury screen structure (e.g., that of HALEY, et al.) the amount of absorption decreases rapidly as either the frequency of the impinging signal deviates from the frequency to which one of the FSS layers is "tuned" or as the angle of incidence of the impinging wave deviates from normal impingement. The inventive absorptive structure, on the other hand, is responsive to RF energy at a much greater degree of deviation from normal incidence.

It is therefore an object of the invention to provide a broadband absorptive structure having a thickness less than $\lambda/4$.

It is a further object of the invention to provide a broadband absorptive structure utilizing a plurality of FSS reflective layers spaced closely together.

It is an additional object of the invention to provide a broadband absorptive structure wherein the closely-spaced FSS reflective layers mutually interact to reflect a coherent signal (0 degrees phase) at a reference plane that is less than $\lambda/4$ distance from the first FSS layer.

SUMMARY OF THE INVENTION

In accordance with the present invention, there is provided a broadband, RF-absorptive structure based on a Salisbury screen. A plurality of closely-spaced FSS reflective layers interacts with a ground plane and each other to reflect a coherent return signal over a broad bandwidth to a spacecloth front layer. The frequency response of the absorptive structure is relatively flat across an octave (i.e., a 2:1 frequency ratio) bandwidth. The overall thickness of the inventive structure is lese than $\lambda/4$ because of the interactions of the FSS layers and the ground plane.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

The present invention features a broadband, RF absorptive structure based on a Salisbury screen. A plurality of closely-spaced FSS reflective layers interacts with a ground plane to reflect a high impedance coherent signal at a spacecloth front layer across at least an octave frequency bandwidth.

The Salisbury screen concept functions on the principle of matching impedances. The 377Ω impedance of an incoming plane wave combined with the high impedance plane wave reflected from the FSS and ground plane layers presents a 377Ω impedance wavefront at the spacecloth.

Figure 1:
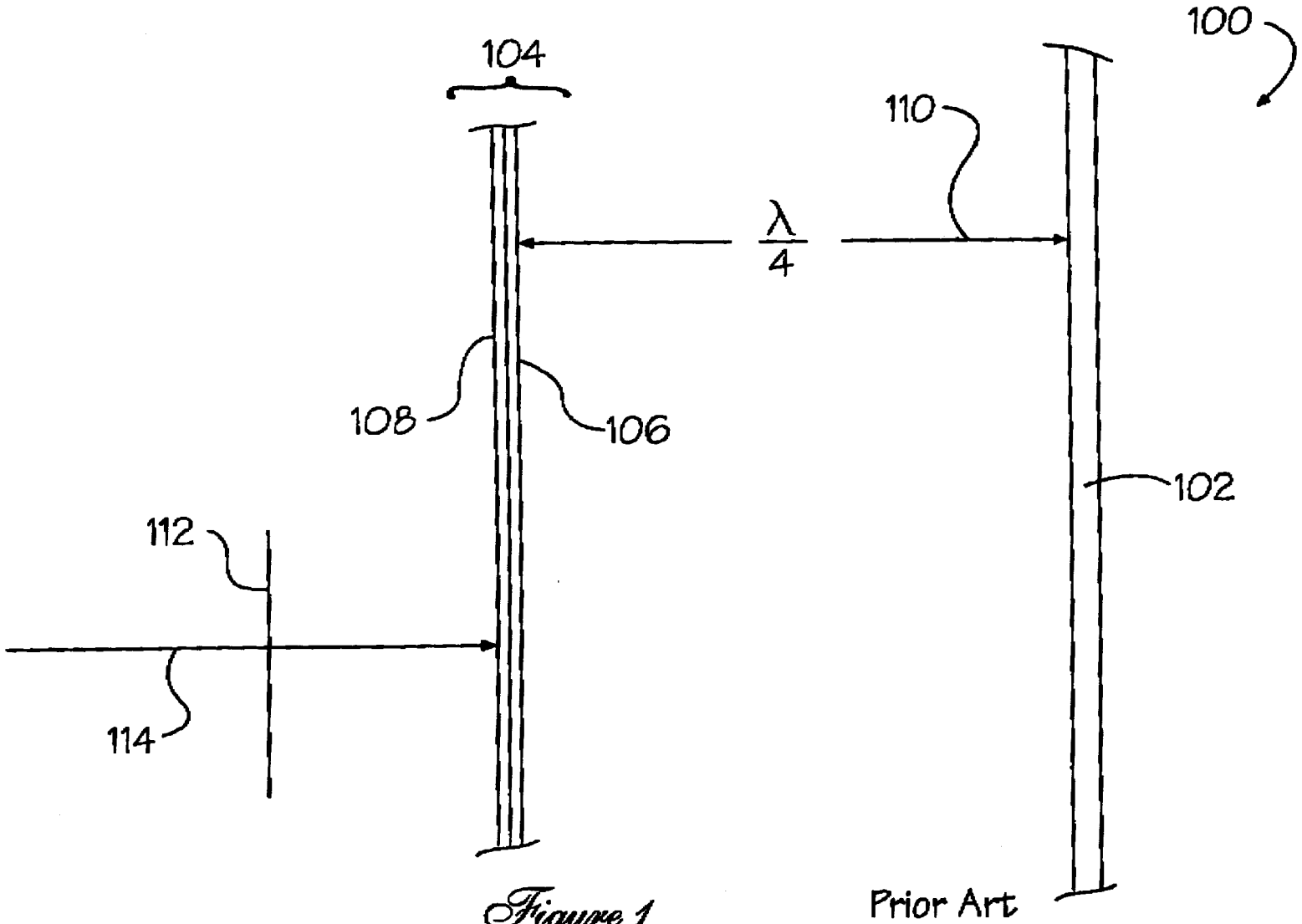
FIG. 1 is a schematic, cross-sectional view of a prior art, single-frequency Salisbury screen absorber.

Referring first to FIG. 1, there is shown a traditional Salisbury screen of the prior art, generally at reference number 100. A ground plane 102 is disposed behind a spacecloth (i.e., a thin resistive sheet) 104. Spacecloth 104 comprises a fabric layer 106 coated or impregnated with an electrically conductive material layer 108. Spacecloth 104 is chosen to have a bulk resistance of 377Ω which matches the characteristic impedance of a plane wave traveling in space.

Because spacecloth 104 and ground plane 102 are separated one from the other by a distance of λ/4 110 at the frequency of interest, the approximately 0Ω impedance of the ground plane is transformed to an open circuit at spacecloth 104. Spacecloth 104 presents a parallel impedance to the transformed open circuit. When a plane wave 112, traveling through space along a direction 114 approximately normal to spacecloth 104 arrives thereat, it is absorbed. This is because the impedance of space cloth 104 exactly matches the impedance of the arriving plane wave 112, so that the energy of the plane wave is substantially completely transformed to spacecloth 104.

As previously discussed, the absorption of plane wave 112 occurs only at a single frequency for which the λ/4 spacing occurs. Also, waves arriving even slightly off normal are not completely absorbed.

Figure 2:
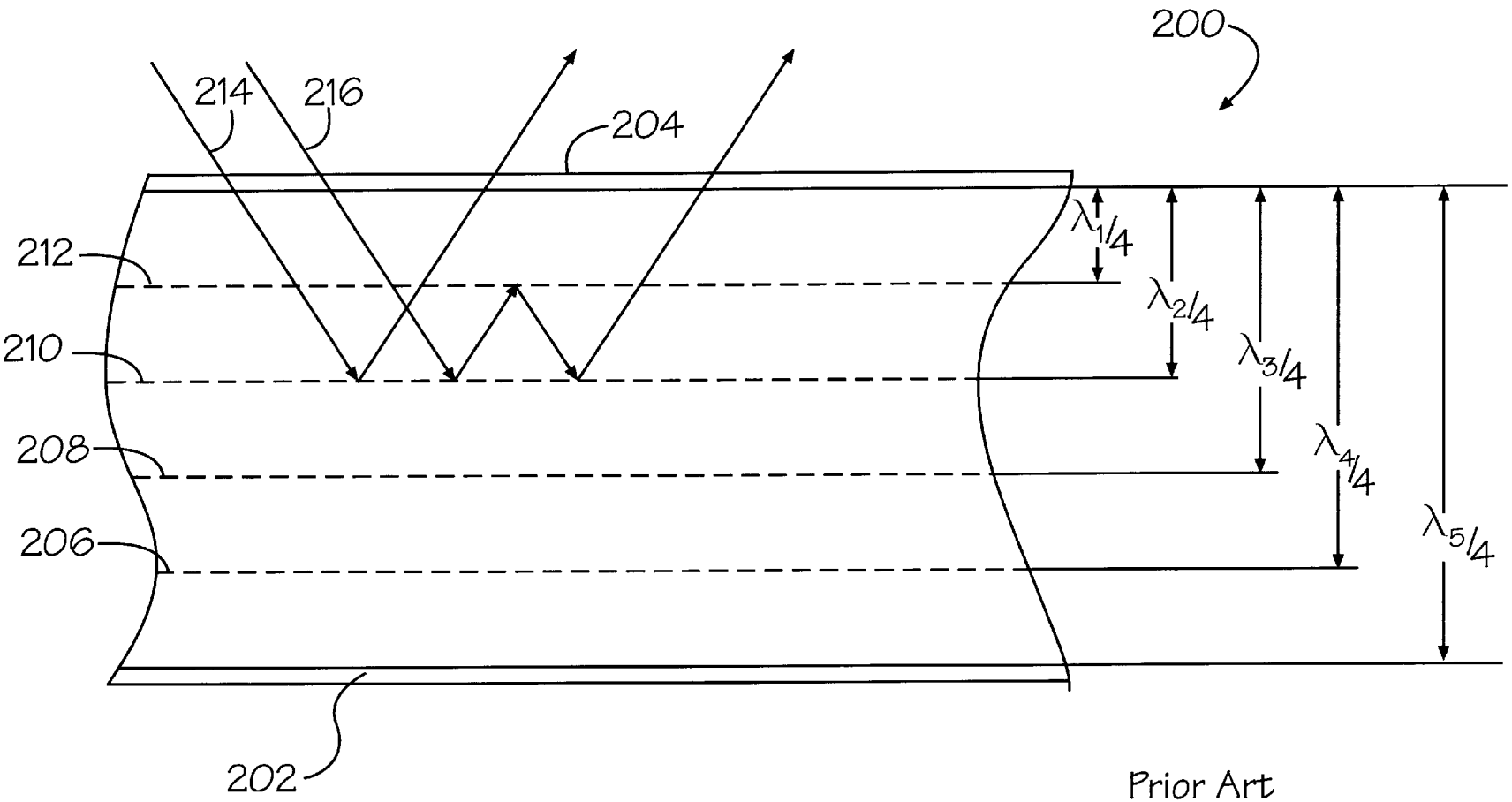
Prior Art Figure 2
FIG. 2 is a schematic, cross-sectional view of a multilayer Salisbury screen-like absorber of the prior art.

Referring now to FIG. 2, there is shown another absorptive structure of the prior art, generally at reference number 200. A ground plane 202 is disposed behind a spacecloth 204. As in the embodiment of FIG. 1, spacecloth 204 is chosen to have a bulk resistance of 377Ω, for the reasons stated in the Salisbury patent. Four frequency selective surfaces 206, 208, 210, 212 are disposed between and substantially parallel to ground plane 202 and spacecloth 204. Each FSS 206 208, 210, 212 is spaced apart from spacecloth 204 a distance corresponding to λ/4 at each of four predetermined frequencies $f_1$, $f_2$, $f_3$, and $f_4$, respectively. The space between ground plane 202 and spacecloth 204 operates at fifth frequency $f_5$ and its corresponding wavelength. Frequency selective surfaces are well known to those skilled in the antenna arts and it will be obvious to those of such skill that a variety of configurations and materials may be used to construct FSSs 206, 208, 210, 212. Typically, these surfaces 206, 208, 210, 212 are depositions of conductive materials in a geometric pattern chosen to resonate effectively at the surface frequency. Typical patterns include intermittent stripes and cross-shaped patterns. The size of the patterns, as well as the space between patterns, must be considered in designing a particular FSS.

While the structure 200 exhibits a broader absorption band than does structure 100 FIG. 1), it still suffers from poor performance for non-normal waves. It has been noted in such structures 200 that the absorption of wavefronts more than 20–30° off-normal is greatly reduced by at least 2–3 dB as a sinusoidal function of the incident angle depending upon whether the wavefront is transverse electric (TE) or transverse magnetic (TM) to the spacecloth normal. One reason for this degradation is that the projection of the incident plane wave impedance is not 377Ω and that, under certain conditions, non-normal RF waves become trapped between the FSS layers 206, 206, 210, 212 and travel laterally. This is illustrated by the path of non-normal waves 214 and 216, which shows that this prior art approach provides discrete frequency reflections.

To achieve absorption over a given bandwidth, these multiple, overlaid FSS layers 206, 209, 210, 212 are each tuned such that their reflectance overlaps at approximately 3 dB points in frequency. Theoretically, a large number of layers could be compiled, thereby creating a very wide bandwidth absorber. However, a structure with a large number of layers (i.e., greater than four or five) becomes unmanageable and unpenetrable to the RF signals. These larger, multi-layer structures seem to have a practical operating bandwidth limit of 100% +/−50% around the desired center operating frequency.

Figure 3:
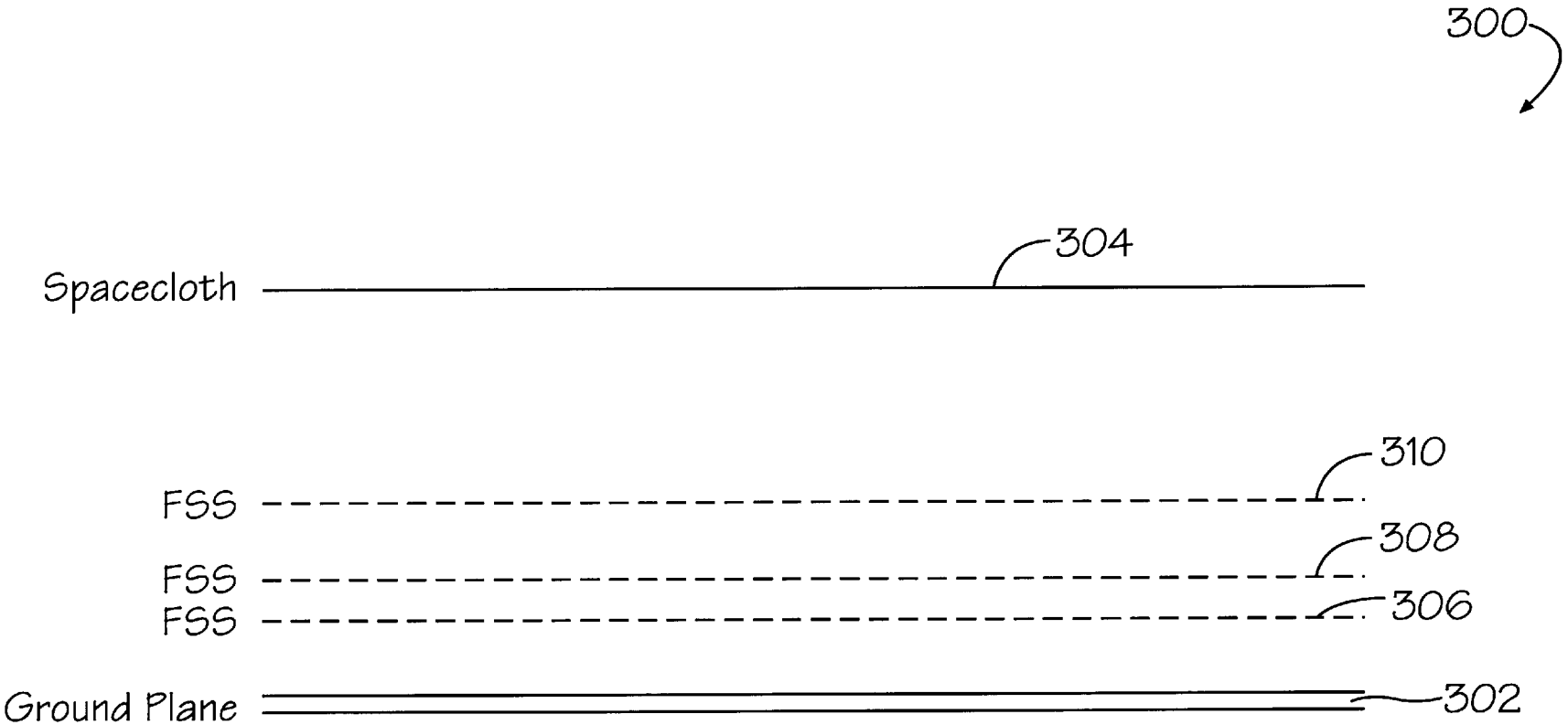
FIG. 3 is a schematic, cross-sectional view of the broadband, multi-layer absorber of the present invention.

Referring now to FIG. 3, there is shown a schematic cross-sectional view of the improved broadband absorptive structure of the present invention, generally at reference number 300. A ground plane 302 and a spacecloth 304 are disposed substantially parallel to one another at a predetermined distance. As with the prior art structure 200 (FIG. 2) described hereinabove, spacecloth 304 is chosen to have a bulk resistance of approximately 377Ω. Three FSS layers 306, 308, 310 are disposed parallel to and between ground plane 304 and spacecloth 306. FSS layers 306, 306, 310 may be typical FSS metallized patterns, well known to those skilled in the antenna design arts.

The spacings of FSS layers 306, 306, 310 are not chosen to be λ/4, as shown in the prior art, but rather are much closer. Two phenomena occur because of the close spacing of FSS layers 306, 308, 310. First, mutual coupling between FSS layers 306, 308, 310 provides a cumulative λ/4 effect on impinging RF signals. Thus, the prior art designs established variable ground plane depths for a particular frequency, but the present invention provides continuous behavior. In effect the inventive absorbing structure 300 provides a virtual continuous λ/4 effect to a broader range of frequencies than possible heretofore.

The present invention also works over a broad range of incident angles to the spacecloth. For a typical λ/4 device of the prior art, the λ/4 distance is deemed to be for orthogonal signals. Incident signals that arrive at angles that are not orthogonal have a longer path length because the signal travels a further distance to the ground plane and a further reflected distance back from the ground to the spacecloth. This greater distance introduces additional degrees of phase error and the signals are no longer coherent. The present invention avoids these difficulties and errors because it is much thinner. The non-orthogonal signals that travel the extra distance to and from the ground plane travel a far lesser distance than in prior art designs. Thus there is less error even at very broad angles of incidence and an improved performance as compared to the prior art.

In one embodiment, instead of the λ/4 spacing of layers of the prior art, the present invention is a factor of 3 or 4 thinner so the at the high end it would be λ/12 or λ/16, and at the low end there would be even less error.

The phase of the reflected signal (not shown) from the stacked FSS layers, as referenced from where the spacecloth is located, usually has a positive slope sawtooth behavior with increasing frequency. The closely-spaced FSS layers 306, 308, 310 act as artificial dielectrics designed to exhibit negative dielectric properties. In the inventive structure, the FSS layers reflect a signal with a phase slope that is flat. To accomplish this, the FSS layers must produce a phase curve that has a negative slope so that, when added to the positive slope wavefront phase progression as the wave travels from the surface of the FSS layers to the spacecloth, the resulting phase is constant with increasing frequency. Reflections from a surface that having a negative dielectric constant have a negative elope phase progression with increasing frequency. There is actually no such thing as a negative dielectric constant material, the concept being a mathematical abstraction. However, the inventive combined layered FSS structures exhibit this kind of behavior, effectively acting as a material having a negative dielectric constant.

In alternate embodiments of the invention, the FSS layers 306, 308, 310 may also, be implemented as resistive structures rather than as conventional metallized FSB layers.

In still other alternate embodiments, ground plane 302 may be implemented as a slot array. Slot radiators operating through the structure at a frequency below the absorption band of the broadband Salisbury screen can penetrate and radiate without obstruction. This allows the absorptive structure to be placed in front of an antenna array. A signal originating at the antenna (i.e., behind the absorptive structure 300) is transmitted outwardly through the structure from back to front. Attenuation (absorption) of as little as 5 dB has been experienced, while an incoming signal passing from front to back experiences approximately a 25 dB attenuation.

Since other modifications and changes varied to fit particular operating requirement, and environments will be apparent to those skilled in the art, the invention is not considered limited to the example chosen for purposes of disclosure, and covers all changes and modifications which do not constitute departures from the true spirit and scope at this invention.

Having thus described the invention, what is desired to be protected by Letters Patent is presented in the subsequently appended claims.

What is claimed is:

1. A thin, multi-layer structure for absorbing radio frequency energy over a range of frequencies centered about a center frequency, comprising:

a) a ground plane;

b) a spacecloth having a predetermined sheet resistance, disposed a first predetermined distance in front of and substantially parallel to said ground plane;

c) a first frequency selective surface disposed a second predetermined distance from said spacecloth, intermediate said ground plane and said spacecloth and substantially parallel thereto; and d) a second frequency selective surface disposed intermediate said first frequency selective surface and said ground plane at a third predetermined distance from said first frequency selective surface;

said second and third predetermined distances being less than one quarter wavelength at said center frequency, whereby electromagnetic coupling between at least two from the group of said ground plane, said spacecloth, said first frequency selective surface and second frequency selective surface causes said thin, multi-layer structure to behave as if said spacecloth were located at substantially one quarter wavelength from said ground plane across said range of frequencies.

2. The thin, multi-layer structure for absorbing radio frequency energy over a range of frequencies centered about a center frequency as recited in claim 1, wherein said predetermined sheet resistance of said spacecloth is approximately 377Ω.

3. The thin, multi-layer structure for absorbing radio frequency energy over a range of frequencies centered about a center frequency as recited in claim 1, wherein at least one of said first frequency and said second frequency selective surface comprises resistive structures.

4. The thin, multi-layer structure for absorbing radio frequency energy over a range of frequencies centered about a center frequency as recited in claim 3, wherein said ground plane comprises a slotted structure that allows substantially unobstructed passage of RF energy from behind said ground plane therethrough.

5. The thin, multi-layer structure for absorbing radio frequency energy over a range of frequencies centered about a center frequency as recited in claim 1, further comprising:

a) a third frequency selective surface disposed intermediate said second frequency selective surface and said ground plane.

6. A thin, multi-layer structure for absorbing radio frequency energy over a range of frequencies centered about a center frequency, comprising:

a) a ground plane;

b) a spacecloth having approximately a 377Ω sheet resistance, disposed a first predetermined distance in front of and substantially parallel to said ground plane; and c) a plurality of frequency selective surfaces, each disposed a different predetermined distance from said spacecloth, intermediate said ground plane and said spacecloth and substantially parallel thereto;

each of said different predetermined distances being less than one quarter wavelength at said center frequency, whereby electromagnetic coupling between at least two from the group of said ground plane, said spacecloth, said plurality of frequency selective surfaces causing said thin, multi-layer structure to behave as if said spacecloth were located at substantially one quarter wavelength from said ground plane across said range of frequencies.

7. The thin, multi-layer structure for absorbing radio frequency energy over a range of frequencies centered about a center frequency as recited in claim 6, wherein at least one of said plurality of frequency selective surfaces comprises a resistive structure.

8. The thin, multi-layer structure for absorbing radio frequency energy over a range of frequencies centered about a center frequency as recited in claim 7, wherein said ground plane comprises a slotted structure that allows substantially unobstructed passage of RF energy from behind said ground plane therethrough.

9. The thin, multi-layer structure for absorbing radio frequency energy over a range of frequencies centered about a center frequency as recited in claim 7, wherein a total distance from said ground plane to said spacecloth is less than one quarter wavelength at said center frequency.

* * * * *